United States Patent [19]

Sonneborn et al.

[11] Patent Number: 4,654,931

[45] Date of Patent: Apr. 7, 1987

[54] HINGE DEVICE WITH BRAKE SPRING FOR TILTING WINDOWS

[75] Inventors: Siegfried Sonneborn, Tangstedt; Manfred Handel; Ernst Mack, both of Weilheim/Teck, all of Fed. Rep. of Germany; Carl F. Gerstrom, Allerød; Peter Sørensen, Lyngby, both of Denmark

[73] Assignee: V Kann Rasmussen Holding A/S, Soborg, Denmark

[21] Appl. No.: 758,218

[22] PCT Filed: Dec. 14, 1984

[86] PCT No.: PCT/DK84/00119

§ 371 Date: Jul. 2, 1985

§ 102(e) Date: Jul. 2, 1985

[87] PCT Pub. No.: WO85/02646

PCT Pub. Date: Jun. 20, 1985

[30] Foreign Application Priority Data

Dec. 15, 1983 [DK] Denmark ..... 5788/83

[51] Int. Cl.[4] ..... E05C 17/64; E05D 1/108

[52] U.S. Cl. ..... 16/337; 16/260

[58] Field of Search ..... 16/337, 260, 321, 335, 16/327, 241

[56] References Cited

U.S. PATENT DOCUMENTS 2,948,916 8/1960 Lewin ..... 16/260

FOREIGN PATENT DOCUMENTS 99616 8/1964 Denmark .
854165 10/1952 Fed. Rep. of Germany .
908230 4/1954 Fed. Rep. of Germany .
354448 3/1973 Sweden .
643168 9/1950 United Kingdom ..... 16/241
1028251 1/1964 United Kingdom .

*Primary Examiner*—Robert P. Olszewski
*Assistant Examiner*—Maurina Rachuba
*Attorney, Agent, or Firm*—Lane & Aitken

[57] ABSTRACT

A hinge device for tilting windows, particularly tilting windows for installation in an inclined roof, includes two hinge parts adapted to be secured to the frame of the window and its sash, respectively, the hinge parts having respective base plates, a guide on one of the base plates, the guide forming a part-circular guide channel, a slide member on the other of the base plates, the slide member corresponding in shape to the guide channel and defining a tilting axis spaced from the plane of the window, a plate element forming the concave guide on one side of the part-circular guide channel, the plate element being spaced from the base plate and secured thereto by rivets or similar pins to the base plate of the hinge part, an arched blade spring arranged in the space between the plate element and the base plate, the blade spring having curved end portions gripping partly around and held in place by two of the rivets securing the plate element, a guide pin on the hinge part having the slide member, the guide pin being positioned to frictionally engage the concave surface of the arched blade spring when the sash is moving close to its closed position, and an undulated spring having legs resting on the convex side of the arched blade spring, the undulated spring spring-loading the arched blade spring while a mid portion is supported against a rivet located intermediate to the two blade spring supporting rivets.

1 Claim, 1 Drawing Figure

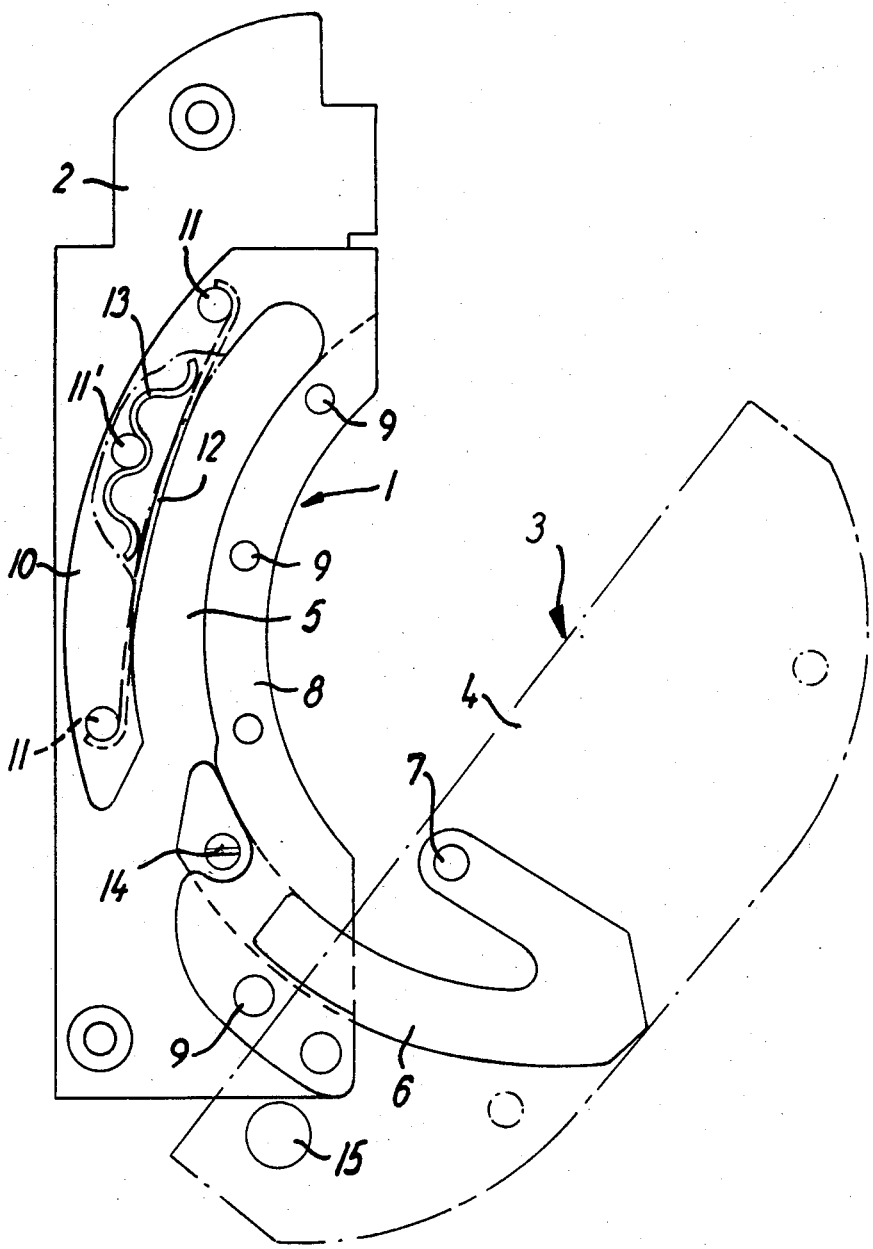
2
11
13
11'
12
9
1
3
10
9
5
8
4
11
7
14
9
6
15

HINGE DEVICE WITH BRAKE SPRING FOR TILTING WINDOWS

BACKGROUND OF THE INVENTION

The specification of Danish Pat. No. 99,616 discloses a hinge device intended for use in tilting windows and comprising two hinge parts adapted to be secured to the frame and the sash, respectively, of the window and including base plates with guide means thereon forming a part-circular guide channel and a corresponding slide member, respectively, defining a tilting axis spaced from the plane of the window. The present invention relates to such a hinge device which is particularly intended for windows to be mounted in an inclined roof and in which, as also applies to the practical embodiments of the hinge devices according to the patent referred to, the concave side of the part-circular guide channel is formed by a plate element, which is spaced from and by means of rivets or similar pins, is secured to the base plate of the hinge part, an arched blade spring being arranged in the spacing between the plate element and the base plate and having curved end portions gripping partly around and held in place by two of the rivets so that when the sash is moving close to its closed position, the concave surface of the blade spring frictionally engages a guide pin belonging to the hinge part with the slide member.

Such a blade spring is inexpensive to manufacture and may be mounted very easily and, generally, functions as intended when it is appropriately dimensioned for the size of the window and appropriately designed, to wit so that when unaffected the mid portion of the spring protrudes slightly from the concave side of the guide channel and has to be pressed backwards by the guide pin sliding therealong. Then the braking effect will to a substantial degree be due to the friction between the concave surface of the blade spring and the moving guide pin, and the conditions should be so that within an appropriately wide angular sector the friction is sufficient to hold the window sash in any desired ventilation position. Thus, the moment of the braking force around the tilting axis should be greater than the sum of the moments with respect to the same axis, of the gravity of the window sash and possible wind pressure thereon but, on the other hand, the braking force should not be great enough to impede the manual opening and closing of the window.

When calculating the dimensions of the spring it may be difficult to pay sufficient regard to these circumstances and, at the same time, to provide for the easy mounting of the blade spring on its carrying rivets as well as its firm connection therewith. In regard to its mounting, the spring should not be too rigid against bending but, at the same time, the braking effect of a too weak spring will be insufficient for the purpose.

SUMMARY OF THE INVENTION

By the invention this dilemma has been solved in the way that the blade spring on its convex side is loaded by an undulated spring, the legs of which rest on the blade spring while its mid portion is supported against a rivet located intermediate the carrying rivets of the blade spring.

The cost of production and insertion of such a wavy or undulated spring will not appreciably increase the cost of the hinge device but by operating so-to-speak in series with the blade spring after the initial bending thereof from its unaffected state, the additional spring will result in a controlled increase of the resistance against bending and thereby optimize the braking effect.

BRIEF DESCRIPTION OF THE DRAWING

An embodiment of the invention is illustrated in the drawing, the hinge parts being shown in their relative position when the sash of the window has been swung open through an angle of about 135°.

DESCRIPTION OF A PREFERRED EMBODIMENT

The hinge device shown in the drawing comprises a guiding part 1 with a base plate 2 intended to be secured by screws to a side member of a window frame, and a slide member part 3 having a base plate 4 which for the sake of clearness is indicated only in dash-and-dot lines and may be screwed onto an associate sash side member.

The hinge part 1 belonging to the window frame presents a downwardly open part-circular guide channel 5 for a correspondingly curved slide member 6 which through a hinge pin 7 is connected with the base plate 4 of the hinge part belonging to the window sash. The concave side or wall 8 of the guide channel 5 is formed by two or more metal stampings which by means of rivets or screws 9 are fixed to the base plate 2. The uppermost one of the stampings is extended into a flange or piece of plate 10 which defines the opposite or concave side of the guide channel. Also this flange or plate 10 is secured to the base plate 2 by means of rivets 11, but it is spaced therefrom and in the spacing a blade spring 12 is arranged having its ends bent partly around the two extreme rivets 11 and being longitudinally curved with a radius greater than that of the guide channel 5 so that the mid portion of the blade spring projects slightly into the channel from the concave side thereof.

Between the convex side of the blade spring 12 intermediate the ends thereof and a third rivet 11' a spring 13 is inserted which is undulated (or shaped like a "w" with rounded corners). The legs of this spring rest on the blade spring while its central section is supported by and partly encircles the rivet 11' so that the undulated or wavy spring 13 is held securely in place by the blade spring 12 hooked on its bearing rivets.

In the situation illustrated on the drawing the slide member 6 has been displaced to its outer end position in the guide channel 5, namely until a stop screw 14 on the free end of the slide member has been received in a pocket formed by the uppermost plate of the wall 8. The base plate 4 of the hinge part belonging to the window sash has been swung further open on the hinge pin 7. When the window is to be closed, the sash with the base plate is first swung backwards until a guide pin 15 secured to this base plate has entered the guide channel 5, thereby being positioned in front of the free end of the slide member. By the further closing movement the pin 15 and the slide member 6 are displaced inwardly (upwardly) in the guide channel, the pin thereby frictionally engaging the blade spring 12 to produce the brake effect as explained above.

We claim:

1. A hinge device for tilting windows, particularly tilting windows for installation in an inclined roof, comprising:

two hinge parts adapted to be secured to the frame of the window and its sash, respectively, said hinge parts having respective base plates;

guide means on one of said base plates, said guide means forming a part-circular guide channel;

a slide member on the other of said base plates, said slide member corresponding in shape to said guide channel and defining a tilting axis spaced from the plane of the window;

a plate element forming the concave guide means on one side of the part-circular guide channel, said plate element being spaced from said base plate and secured thereto by means of rivets or similar pins to the base plate of the hinge part;

an arched blade spring arranged in the space between said plate element and base plate, said blade spring having curved end portions gripping partly around and held in place by two of said rivets securing said plate element;

a guide pin on said hinge part having said slide member, said guide pin being positioned to frictionally engage the concave surface of said arched blade spring when the sash is moving close to its closed position; and an undulated spring having legs resting on the convex side of said arched blade spring, said undulated spring springloading said arched blade spring while a mid portion is supported against a rivet located intermediate to the two blade spring supporting rivets.

* * * * *